US010874568B2

(12) United States Patent
Yang et al.

(10) Patent No.: US 10,874,568 B2
(45) Date of Patent: Dec. 29, 2020

(54) METHOD OF USING A MEDICAL APPARATUS WITH A CRANK MECHANISM FOR STANDING AID

(71) Applicant: Hefei University of Technology, Hefei (CN)

(72) Inventors: Jiaoyun Yang, Hefei (CN); Ping Zhao, Hefei (CN); Aiguo Wang, Hefei (CN); Ning An, Hefei (CN)

(73) Assignee: HEFEI UNIVERSITY OF TECHNOLOGY, Anhui Province (CN)

( * ) Notice: Subject to any disclaimer, the term of this patent is extended or adjusted under 35 U.S.C. 154(b) by 293 days.

(21) Appl. No.: 16/118,181

(22) Filed: Aug. 30, 2018

(65) Prior Publication Data

US 2018/0369045 A1 Dec. 27, 2018

Related U.S. Application Data

(63) Continuation of application No. 15/627,256, filed on Jun. 19, 2017, now Pat. No. 10,085,906.

(30) Foreign Application Priority Data

Jun. 21, 2016 (CN) ..... 2016 1 0459691
Jun. 21, 2016 (CN) ..... 2016 1 0460110

(51) Int. Cl.
*A61G 7/10* (2006.01)
*A61G 5/14* (2006.01)
*A61H 3/00* (2006.01)

(52) U.S. Cl.
CPC ..... *A61G 7/1017* (2013.01); *A61G 5/14* (2013.01); *A61H 3/00* (2013.01); *A61H 3/008* (2013.01)

(58) Field of Classification Search
CPC ..... A61G 7/1017; A61G 5/14; A61H 1/0281; A61H 1/0274; A61H 1/0229;
(Continued)

(56) References Cited

U.S. PATENT DOCUMENTS 2,210,269 A 8/1940 Taylor
3,473,174 A 10/1969 Cool
(Continued)

OTHER PUBLICATIONS

File History of U.S. Appl. No. 15/627,256, filed Jun. 19, 2017.

*Primary Examiner* — Rachel T Sippel
*Assistant Examiner* — Benjamin M. Kusiak
(74) *Attorney, Agent, or Firm* — Michael X. Ye; Morris, Manning & Martin, LLP

(57) ABSTRACT

A medical apparatus for standing aid includes a backrest (4) that has at least one side thereof provided with a crank rocker mechanism that includes a crank mechanism (1), a triangle linkage mechanism (2), and a rocker mechanism (3), the crank mechanism (1) is rotatably connected to the triangle linkage mechanism (2) such that an included angle between a second driven link (BE) of the triangle linkage mechanism (2) and the crank mechanism (1) is always smaller than 90°, and the crank mechanism (1) driving the triangle linkage mechanism (2), the rocker mechanism (3) and the backrest (4) connected to the triangle linkage mechanism to perform interactive movement repeatedly along a predetermined curve trajectory in response to a driving force from a drive effect of a driving unit (100), so that the backrest (4) connected to the second driven link (BE) assists a trainee in standing up repeatedly by obliquely supporting the trainee's waist.

9 Claims, 4 Drawing Sheets

(58) Field of Classification Search
CPC .... A61H 2201/5097; A61H 2201/0184; A61H 2230/305; A61H 2230/425; A61H 2201/5071; A61H 2230/805; A61H 2230/505; A61H 2230/825; A61H 2201/1623; A61H 2230/065; A61H 2201/1628; A61H 2201/0134; A61H 2201/50; A61H 2201/164; A61H 2201/5082; A61H 2201/0149; A61H 2201/1436; A61H 2201/1614; A61H 2201/123; A61H 2201/1633; A61H 2201/1676; A61H 3/00–008; A63B 23/0222
See application file for complete search history.

(56) References Cited

U.S. PATENT DOCUMENTS

| | | | |
|---|---|---|---|
| 3,629,880 | A | 12/1971 | van Rhyn |
| 4,807,897 | A | 2/1989 | Schultz |
| 4,833,736 | A | 5/1989 | Sadler et al. |
| 4,884,841 | A | 12/1989 | Holley |
| 5,155,873 | A | 10/1992 | Bridges |
| 5,312,157 | A | 5/1994 | Logan, Jr. |
| 5,683,321 | A | 11/1997 | Barnett |
| 5,984,411 | A | 11/1999 | Galumbeck |
| 6,119,287 | A | 9/2000 | Phillips |
| 6,142,568 | A | 11/2000 | Abelbeck et al. |
| 6,213,554 | B1 | 4/2001 | Marcoux et al. |
| 6,588,792 | B1 | 7/2003 | Koerlin |
| 6,715,784 | B2 | 4/2004 | Koerlin |
| 6,770,040 | B2 | 8/2004 | Perner et al. |
| 6,811,220 | B2 | 11/2004 | Shea et al. |
| 6,976,699 | B2 | 12/2005 | Koerlin |
| 7,219,960 | B1 | 5/2007 | Hajianpour |
| 7,247,128 | B2 | 7/2007 | Oga |
| 7,543,885 | B2 | 6/2009 | Pollard et al. |
| 7,544,155 | B2 | 6/2009 | Agrawal et al. |
| 7,601,104 | B2 | 10/2009 | Agrawal et al. |
| 7,735,926 | B1 | 6/2010 | Combs |
| 7,938,756 | B2 | 5/2011 | Rodetsky et al. |
| 8,147,436 | B2 | 4/2012 | Agrawal et al. |
| 8,398,171 | B2 | 3/2013 | Lin et al. |
| 8,556,347 | B2 | 10/2013 | Lin et al. |
| 9,616,282 | B2 | 4/2017 | Tholkes et al. |
| 9,839,567 | B2 | 12/2017 | Hacikadiroglu et al. |
| 2006/0097557 | A1 | 5/2006 | Tholkes et al. |
| 2006/0260621 | A1 | 11/2006 | Agrawal et al. |
| 2008/0255488 | A1 | 10/2008 | Agrawal et al. |
| 2009/0298653 | A1* | 12/2009 | Rodetsky ..... A61H 1/0262 482/69 |
| 2010/0270771 | A1 | 10/2010 | Kobayashi et al. |
| 2013/0221716 | A1* | 8/2013 | Purwar ..... A61G 7/1073 297/311 |
| 2015/0018177 | A1* | 1/2015 | Oblak ..... A63B 23/0405 482/142 |
| 2015/0359692 | A1* | 12/2015 | Elnatan ..... A61G 5/12 297/183.1 |
| 2016/0051427 | A1* | 2/2016 | Purwar ..... A63B 21/00069 482/5 |
| 2017/0056262 | A1* | 3/2017 | Yamada ..... A61G 7/1038 |
| 2017/0128292 | A1* | 5/2017 | Tsusaka ..... A61G 5/14 |
| 2017/0136295 | A1* | 5/2017 | Tholkes ..... A61B 5/486 |

* cited by examiner

METHOD OF USING A MEDICAL APPARATUS WITH A CRANK MECHANISM FOR STANDING AID

This Application is a continuation of U.S. patent application Ser. No. 15/627,256, filed on Jun. 19, 2017, which claims priority from Application No. CN 201610459691.0, filed Jun. 21, 2016 and CN 201610460110.5, Jun. 21, 2016. The entirety of the aforementioned application is incorporated herein by reference.

FIELD OF THE INVENTION

The present invention relates to medical apparatuses, and particularly to a medical apparatus for standing aid.

BACKGROUND OF THE INVENTION

With the development of technology, the disabled expect to improve their moving ability, for example, the ability of standing and walking, and even recover by medical training. However, most auxiliary medical devices in the market are wheelchairs, which can only support patient while sitting. While sedentary comes with walking ability decline, and goes against the patients' training and recovering. For the moment, the most important issue is how to help the patient in better standing and walking training.

CN 101947180A discloses an auxiliary standing training device that includes a bottom frame, a flexible pipe, a hollow connecting member, a first support rod, a second support rod and a beam; wherein the bottom frame is provided with a first support rod and a second support rod, a movable connecting pipe is sleeved outside the second support rod; one end of a hollow connecting member is fixedly connected with a fixed pipe while the other end is hinged with the movable connecting pipe; a flexible pipe is arranged inside the fixed pipe; a first reset spring is arranged inside the fixed pipe at the top end of the flexible pipe; a handrail is arranged at the outer end of the flexible pipe; a safe belt hook is arranged on the handrail; a second reset spring is arranged inside the movable connecting pipe at the top end of the second support rod; one end of a beam is connected with the first support rod while the other end is fixed with a knee top plate; an output shaft of a drive motor reduction gear is provided with a first steel wire rope wheel; and a second steel wire rope wheel is arranged in the hollow connecting member.

Although the above-mentioned auxiliary standing training device can help the disabled with better training on standing, it is still tedious in the training form. The trainees could not understand how their training and rehabilitation are going, and thus could not adjust their training intensity based on their conditions.

SUMMARY OF THE INVENTION

A medical apparatus for standing aid comprises a crank rocker mechanism provided on at least one side of a backrest, wherein the crank rocker mechanism comprises a crank mechanism, a triangular linkage mechanism, and a rocker mechanism, and wherein the crank mechanism is rotatably connected to the triangular linkage mechanism such that an included angle between a second driven link of the triangular linkage mechanism and the crank mechanism is always smaller than 90.degree, and the crank mechanism drives the triangular linkage mechanism, the rocker mechanism and the backrest connected to the triangular linkage mechanism to perform interactive movement repeatedly along a predetermined curve trajectory in response to a drive effect resulting from a driving force a driving unit, so that the backrest connected to the second driven link assists a trainee in standing up repeatedly by obliquely supporting the trainee's waist.

According to one preferred embodiment, the triangular linkage mechanism is of an acute triangular structure composed of a first driven link, a second driven link, and a third driven link, in which the first driven link and the second driven link include an included angle of 40.degree, and the first driven link and the third driven link include an included angle of 60.degree, while the second driven link and the third driven link include an included angle of 80.degree, and the triangular linkage mechanism has a third apex that is connected to the backrest and guides the trainee's shoulder fastened to the backrest to perform to-and-fro movement along a predetermined curve trajectory.

According to one preferred embodiment, in the crank rocker mechanism, the first driven link is greater than the second driven link in length, the second driven link is greater than the rocker mechanism in length, the rocker mechanism is greater than the third driven link in length, and the third driven link is greater than the crank mechanism in length, wherein the crank mechanism, the triangular linkage mechanism, and the rocker mechanism are vertically linked so as to drive the backrest to move, and the crank rocker mechanism modulates the curve trajectory of the backrest according to a drive frequency of the driving unit and a rotation angle of a motor.

According to one preferred embodiment, the backrest is parallel to and rigidly connected to the second driven link, and two connecting points between the backrest and the second driven link are located within a half of the second driven link that is relatively close to the third apex.

According to one preferred embodiment, the backrest is equipped with shoulder strips at two sides thereof for providing a pulling force to the trainee's shoulders during operation of the crank rocker mechanism, and the backrest is equipped with a waist band at a bottom end thereof for providing a pulling force to the trainee's waist.

According to one preferred embodiment, in the triangular linkage mechanism, the first driven link has one end thereof rigidly connected to the second driven link, and has an opposite end thereof rigidly connected to the third driven link, while the second driven link is rigidly connected to the third driven link.

According to one preferred embodiment, the triangular linkage mechanism is articulated to the crank mechanism at a rigid joint between the first driven link and the second driven link, and the triangular linkage mechanism is articulated to the rocker mechanism at a rigid joint between the first driven link and the third driven link.

According to one preferred embodiment, in the crank rocker mechanism, the crank mechanism is further connected to an intermediate axle so that the crank mechanism receives kinetic energy provided by a motor through the intermediate axle, and the crank mechanism drives the crank rocker mechanism to operate by taking its connecting point with the intermediate axle as the center of circle and taking a length of the crank mechanism as the radius, in which the crank mechanism can be driven by the intermediate axle to rotate clockwise or anticlockwise about the intermediate axle, thereby driving the entire crank rocker mechanism to move upward or downward.

According to one preferred embodiment, the medical apparatus for standing aid further comprises a motor for powering the crank rocker mechanism and a drive mechanism for transferring kinetic energy of the motor, in which the drive mechanism includes a primary chain drive mechanism, a long axle, a secondary chain drive mechanism, and an intermediate axle.

According to one preferred embodiment, the medical apparatus for standing aid works with a data processing cloud terminal to realize smart data processing, wherein the smart data processing involves: recommending a rehabilitation training program with reference to an expert knowledge library in the cloud terminal; performing real-time adjustment on the rehabilitation training program according to the trainee's rehabilitation progress; and performing personalized update on a sitting-rising training by using machine learning.

A medical apparatus for standing aid comprises a driving unit, a linkage unit, a seat unit, a data harvesting unit, and a motion-assessing unit installed on a frame, wherein the linkage unit is driven by the driving unit to work in the form of interaction between crank and rocker and thereby assist a trainee sitting on the seat unit in sitting-rising movement, and the motion-assessing unit assesses the trainee's physical condition according to trainee's exercise data collected by the data harvesting unit and performs real-time adjustment on the trainee's training frequency and training duration, in which the linkage unit comprises at least one crank rocker mechanism that includes a triangular linkage mechanism that assists the trainee's shoulders to perform the sitting-rising movement following a fitted shoulder motion curve.

According to one preferred embodiment, the crank rocker mechanism comprises a crank mechanism, a triangular linkage mechanism, a rocker mechanism, and a backrest, in which a first apex and a second apex of the triangular linkage mechanism are connected to the crank mechanism and the rocker mechanism, respectively, and a third apex of the triangular linkage mechanism is connected to the backrest that holds the trainee's shoulders in position, so as to assist the trainee's shoulders to move following the shoulder motion curve during the trainee's sitting-rising movement.

According to one preferred embodiment, at least two said crank rocker mechanisms are symmetrically provided at two ends of the backrest, and at least one apex of the backrest is fixedly connected to the corresponding third apexes of the triangular linkage mechanisms.

According to one preferred embodiment, the backrest is a rectangular backrest with upper apexes thereof fixedly connected to the corresponding third apexes of the triangular linkage mechanisms, and with lower apexes thereof fixedly connected to corresponding fixing points on a second driven link between the third apex and the first apex of the triangular linkage mechanism.

According to one preferred embodiment, the data harvesting unit collects the trainee's exercise data including the trainee's training frequency, training duration, data of pressure that the trainee exerts on a footrest and/or the trainee's biological information that includes the trainee's body height, body weight, heart rate, blood pressure, breathing rate and/or body temperature.

According to one preferred embodiment, the data harvesting unit at least comprises at least one pressure sensor provided on the footrest at a lower end of the frame, a biological information sensor and a shoulder motion curve sensor installed on the backrest.

According to one preferred embodiment, the motion-assessing unit comprises a data processing unit, an assessment unit, and a control unit, wherein the data processing unit filters the exercise data collected by the data harvesting unit for effective data and sends the effective data to the assessment unit, the assessment unit assesses the trainee's physical condition and shoulder motion curve according to the effective data, and the control unit adjusts the trainee's training frequency, training duration and shoulder motion curve according to assessment made by the assessment unit.

According to one preferred embodiment, the backrest is provided with at least two shoulder strips for fastening the trainee's shoulders and at least one waist band for transversely fixing the trainee's trunk, in which the shoulder strips and/or the waist band are equipped with at least one biological information sensor and/or shoulder motion curve sensor.

According to one preferred embodiment, the driving unit comprises a motor, a long axle, an intermediate axle, and a secondary chain drive low-speed wheel, wherein the motor is connected to the long axle through the primary chain drive mechanism, the long axle has two ends thereof connected to two symmetrical secondary chain drive low-speed wheels, respectively, through the secondary chain drive mechanism, and the secondary chain drive low-speed wheel is rotatably connected to one end of the crank mechanism through the intermediate axle, so that the linkage unit provides the aid based on a drive force of the driving unit.

According to one preferred embodiment, the seat unit comprises a back cushion, a fastening mechanism, a seat support, and a seat cushion, wherein the seat support comprises a U-shaped structure and a bar-like structure vertically connected to the U-shaped structure as a whole, the bar-like structure of the seat support is adjustably fixed to a vertical tube of the frame through the fastening mechanism, the U-shaped structure has two ends thereof each provided with at least one through hole for fixing the seat cushion, and the back cushion is attached to one end of the bar-like structure.

Advantages of the medical apparatus for standing aid described herein may include one or more of the following.

(1) In moving of the crank mechanism driven by the triangular linkage mechanism, the included angle between the second driven link and the crank mechanism is always smaller than 90 degrees, which is beneficial to make the second driven link lean back relative to its joint with the crank mechanism, so that the backrest connected to the second driven link can be also leaning back during performing of the crank rocker mechanism. In the process of sitting-rising training, the backrest of medical apparatus for standing aid not only provides upward pulling force to a trainer's body by shoulder strips and waist band, but also provides supporting force to the trainers' body by the leaning back backrest, so that can protect the trainer from hurting by the only pulling force provided by the shoulder belt and waist belt during sitting-rising training.

(2) In the process of sitting-rising training, the backrest connected to the second driven link of the triangular linkage mechanism moves along an obliquely upward or obliquely downward trajectory, so that the human body during the standing up or sitting down movement moves in a trajectory that is ergonomically. As the backrest is not move simply upward or downward, it can provide better assist in the rehabilitative sitting-rising training of trainer.

(3) In the sitting-rising training process of a trainer, the invention apparatus can collect the exercise data and assesses the trainee's recovery and provide suggestions on the exercise and information about his/her rehabilitation to the trainee, so that the trainee can perform correct rehabilitation training on his/her own.

(4) In view of the production process, the invention apparatus has a standardized design, short production cycle, low cost and is simple and easy in manufacture. The invention provides a rehabilitation medical equipment of low consumption, which has a broad market prospects.

(5) The invention optimizes sizes of the mechanisms based on ergonomics and takes into consideration of the adjustment of altitude and front and rear position of the seat, so that to improve comfort for trainee without prejudice to the rehabilitation effect.

(6) In addition to separately assisting a patient in the rehabilitation training of sitting-rising, the invention apparatus can also work in combination with the other rehabilitation medical devices to adjust the patient's posture for other related rehabilitation therapy.

| Reference numbers | |
|---|---|
| 1: crank mechanism | 2: triangular linkage mechanism |
| BC: first driven link | BE: second driven link |
| CE: third driven link | 3: rocker mechanism |
| 4: backrest | 5: frame |
| 6: seat | 7: motor |
| 8: primary chain drive mechanism | 9: long axle |
| 10: secondary chain drive mechanism | 11: vertical tube |
| 12: horizontal tube | 13: vertical bearing housing |
| 14: motor support | 15: motor mount |
| 16: rhombic bearing housing | 17: footrest |
| 18: intermediate axle | |
| 19: secondary chain drive low-speed wheel | |
| 20: back cushion | 21: fastening mechanism |
| 22: seat support | 23: seat cushion |
| 51: first round tube | 52: second round tube |
| 53: third round tube | 100: driving unit |
| 200: linkage unit | 300: seat unit |
| 400: data harvesting unit | 500: motion-assessing unit |
| 501: data processing unit | 502: assessment unit |
| 503: control unit | |

DETAILED DESCRIPTION OF THE EMBODIMENTS

The invention as well as a preferred mode of use, further objectives and advantages thereof will be best understood by reference to the following detailed description of illustrative embodiments when read in conjunction with the accompanying drawings.

As used in the present invention, the triangular linkage mechanism is also referred to as the triangular load-bearing frame.

Figure 1:
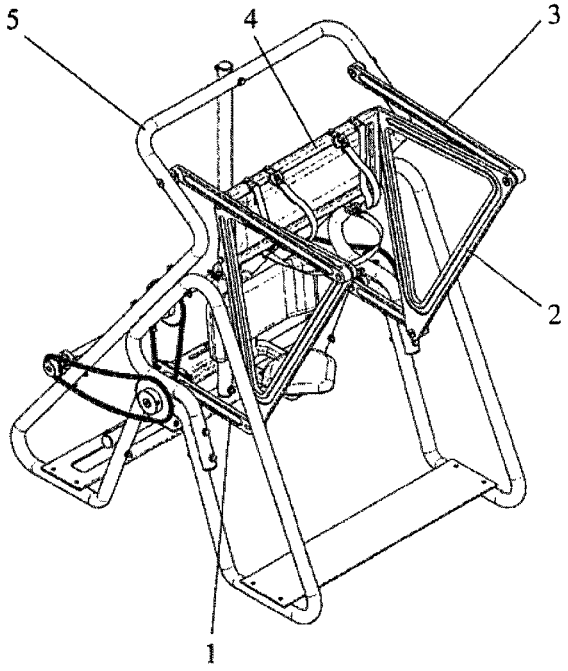
FIG. 1 is a front perspective view of the medical apparatus according to the present invention.
Figure 2:
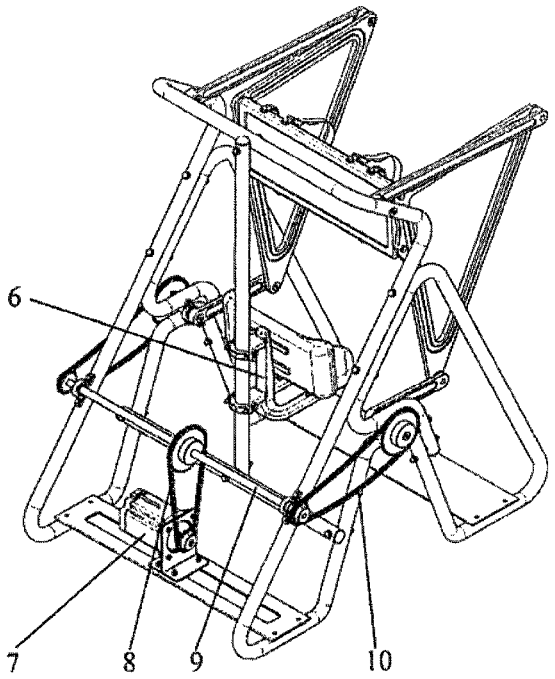
FIG. 2 is a back perspective view of the invention medical apparatus.

FIG. 1 and FIG. 2 are perspective views of a medical apparatus of the present invention. As shown in FIG. 1 and FIG. 2, the disclosed medical apparatus comprises a crank rocker mechanism for supporting a trainee's body to perform sitting-rising movement, a backrest 4 for providing the trainee with back support, a frame 5 for supporting the medical apparatus, a seat 6 for the trainee to sit on, a motor 7 for powering the crank rocker mechanism, a primary chain drive mechanism 8 for transferring kinetic energy from the motor 7, a long axle 9 for receiving and transferring kinetic energy from the primary chain drive mechanism 8, and a secondary chain drive mechanism 10 for transferring kinetic energy received by the long axle 9.

Figure 5:
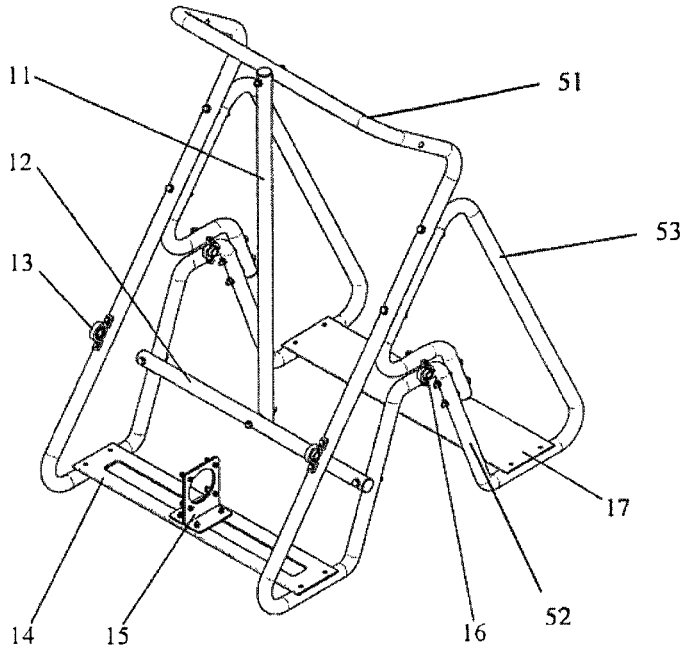
FIG. 5 is a perspective view of the invention frame.

FIG. 5 schematically depicts the structure of the frame. The frame 5 serves to carry a driving unit 100, a linkage unit 200, and a seat unit 300. The frame 5 is composed of at least one bent round tube welded together and jointed with screw bolts. Preferably, the frame 5 is composed of five bent round tubes. The bent round tubes are joined by means of welding and screw bolts. Fabricating the frame 5 with multiple round tubes is favorable to transportation and bending process of the round tubes.

As shown in FIG. 5, the frame 5 is composed of a first round tube 51, two second round tubes 52, and two third round tubes 53. The first round tube 51 includes two symmetrical Z-shaped parts that each have a Z-shaped section and a crossbeam part connecting between tops of the two symmetrical Z-shaped parts. The second round tubes 52 are each formed into a rough trapezoid, but the round tube at the bottom of the trapezoid has its two ends bent symmetrically in opposite directions. The two second round tubes 52 are symmetrically connected to two ends of the first round tube 51. The third round tubes 53 are bent to match with the shape of the second round tube 52. The third round tube 53 has its one end bent with a certain angle from horizontal. The bending angle of the third round tube 53 is the same as the base angle of the trapezoid formed by the second round tube 52. The third round tube 53 has an opposite end including plural bends, so that the third round tube 53 matches with the shape of the first round tube 51 and the second round tube 52 in vertical plane. The two third round tubes 53 are connected to the first round tube 51 and the second round tube 52 symmetrically and respectively. Wherein, the third round tubes 53 and the inclined part at the middle of the Z-shaped part of the first round tube 51 are connected using screw bolts. The third round tube 53 has its one end connected to one end of the second round tube 52, and has its opposite end bent along the trapezoid' upper base formed by the second round tube 52 and connected to the upper part of the leg of the trapezoid by means of screw bolts. Preferably, in the present invention, the round tubes have the bends formed as rounded corners, so as to protect the trainee from any acute corner.

The vertical tube 11 stands upright on the vertical line of symmetry of the first round tube 51, with its one end connected to the center point of the crossbeam part of the first round tube 51. The horizontal tube 12 horizontally and symmetrically connects the legs of the trapezoids formed by the two second round tubes 52, with its center point connected to one end of the vertical tube 11. Preferably, the two third round tubes 53 are connected by a footrest 17 horizontally arranged therebetween. The two Z-shaped parts of the first round tube 51 have their bottom connected by a motor support 14 that is horizontally disposed between them. The motor support 14 has its two ends fixed to the frame 5 by means of screws. The motor support 14 is structurally a rectangular board centrally formed with a rectangular opening. The opening has a length roughly equal to the distance between two sides of the first round tube 51 of the frame 5. The motor support 14 is provided with a motor mount 15 at its middle part for a motor 7 to be installed thereon. The motor mount 15 and the motor support 14 are combined using screws. The motor 7 is settled in the motor mount 15. The motor mount 15 is positionally adjustable against the motor support 14 for fitting the motor in size, so as to facilitate the installation of the motor 7, and ensure the center of gravity of the motor 7 is at the center of the motor support 14, thereby preventing the medical apparatus from losing balance and even rolling over due to the center-of-gravity shift of the motor 7. The motor 7 may rotate forward and reversely according to practical needs. Meanwhile, the motor mount 15 can absorb and isolate shocks, so it can hold the motor 7 while ensuring steadiness of the whole medical apparatus and conformable experience to its users.

The driving unit 100 serves to provide the linkage unit 200 with a driving force. As shown in FIG. 2, the driving unit 100 comprises the motor 7, the long axle 9, an intermediate axle 18 and a secondary chain drive low-speed wheel 19. The motor 7 and the long axle 9 are connected through the primary chain drive mechanism 8, so that the kinetic energy of the motor 7 can be transferred to the long axle 9. The long axle 9 is connected to the intermediate axle 18 with rotating wheels at its two ends through the secondary chain drive mechanism 10. The intermediate axle 18 has its one end connected to the secondary chain drive low-speed wheel 19, and has its opposite end connected to the crank mechanism 1. The two secondary chain drive low-speed wheels 19 are connected to the two ends of the long axle 9, respectively, through the secondary chain drive mechanism 10. The long axle 9 delivers the kinetic energy that has been transferred from the motor 7 to the long axle 9 to the secondary chain drive low-speed wheel 19 through the secondary chain drive mechanism 10. That is, the secondary chain drive low-speed wheel 19 receives the power transferred by the secondary chain drive mechanism 10, The secondary chain drive low-speed wheel 19 is mounted around the intermediate axle 18, so that the secondary chain drive low-speed wheel 19 can drive the intermediate axle 18 to rotate, and transfers the kinetic energy to the intermediate axle 18. The intermediate axle 18 serves to then transfer the kinetic energy of the secondary chain drive low-speed wheel 19 to the crank mechanism 1, thereby making the linkage unit 200 perform aiding movement based on the driving force of the driving unit 100.

Figure 6:
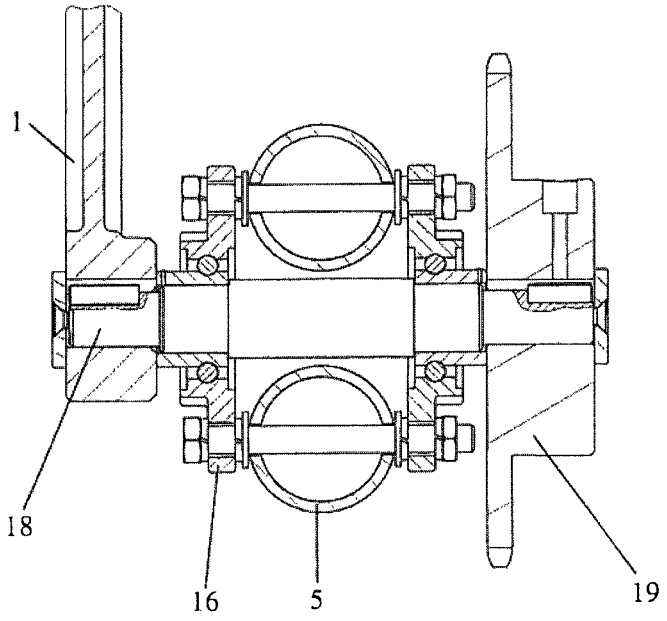
FIG. 6 is a schematic drawing depicting the invention intermediate axle structure.
Figure 7:
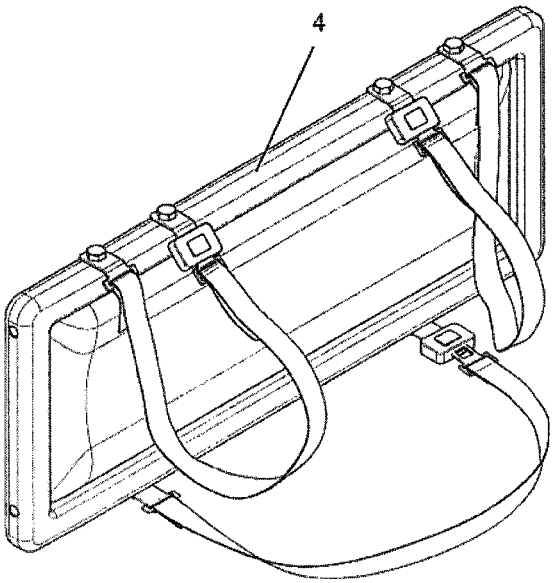
FIG. 7 is a perspective view of the invention backrest.

As shown in FIG. 5 and FIG. 6, each of the two Z-shaped parts symmetrical at two sides of the first round tube 51 is provided with a vertical bearing housing 13. The vertical bearing housings 13 are fixed to the frame 5 by means of screws. The long axle 9 horizontally bridges between two vertical bearing housings 13. The vertical bearing housings 13 serve to support the long axle 9. The long axle 9 is allowed to freely rotate in the two vertical bearing housing 13. The primary drive chain mechanism 8 is installed on the long axle 9 and aligned with the motor 7. The primary drive chain mechanism 8 has its one end connected to the motor 7. The motor 7 is a servomotor configured to provide forward and reverse rotating force within a certain angular range. Two rhombic bearing housings 16 are installed at the upper bases of the trapezoids formed by the two symmetrical second round tubes 52, respectively, for supporting the intermediate axle 18. The rhombic bearing housings 16 are fixed to the second round tubes 52 of the frame 5 by means of screws. The rhombic bearing housings 16 serve to support the intermediate axle 18. The intermediate axle 18 has its middle part located between the two rhombic bearing housings 16 and allowed to freely rotate in the rhombic bearing housings 16. The crank rocker mechanism modulates the curve trajectory of the backrest 4 according to the drive frequency of the driving unit 100 and the rotation angle of the motor.

The linkage unit 200 serves to assist the trainee during his/her training for standing. The linkage unit 200 makes the trainee's shoulders move along a predetermined shoulder motion curve when the trainee stands up and sits down. The linkage unit 200 includes the crank rocker mechanism and the backrest 4. The crank rocker mechanism is composed of the crank mechanism 1, the triangular linkage mechanism 2, and a rocker mechanism 3. The crank rocker mechanism includes a first crank rocker mechanism and a second crank rocker mechanism. The at least two crank rocker mechanisms are symmetrically arranged at two ends of the backrest 4. The backrest 4 has at least one apex fixedly connected to the third apex E of the corresponding triangular linkage mechanism 2, so that the backrest 4 receives force in a balanced manner, thereby helping the trainee to maintain balance while standing up and sitting down. The first crank rocker mechanism shown in FIG. 4 comprises a first crank mechanism that actively exerts force as well as a first driven link BC, a second driven link BE and a third driven link CE that are driven to move by the first crank mechanism. The first crank rocker mechanism further comprises a first rocker mechanism.

The crank mechanism 1 and the rocker mechanism 3 are rod-like mechanisms. The triangular linkage mechanism 2 is a triangular structure that has three apexes. The three apexes are a first apex B, a second apex C, and a third apex E. The crank mechanism 1 has its one end connected to the intermediate axle 18, and has its opposite end connected to the first apex B of the triangular linkage mechanism 2. That is, the triangular linkage mechanism 2 and the crank mechanism 1 are connected to each other. The rocker mechanism 3 has its one end rotatably fixed to one end of the crossbeam part of the first round tube 51, and has its opposite end connected to the second apex C of the triangular linkage mechanism 2.

The triangular linkage mechanism 2 has its third apex E connected to the backrest 4 that holds the trainee's shoulders. The triangular linkage mechanism 2 receives kinetic energy provided by the crank mechanism 1, and drives the backrest 4 connected to the triangular linkage mechanism 2 to move, so that the medical apparatus can support the trainee to stand using the movement of the backrest 4, thereby helping the trainee with sitting-rising training.

The triangular linkage mechanism 2 has its third apex E connected to the backrest 4 and guides the trainee's shoulders fastened to the backrest 4 to perform back-and-forth movement along a predetermined curve trajectory. The rocker mechanism 3 serves to assist the triangular linkage mechanism 2 to move, so that the backrest 4 can move along an ergonomic trajectory, thereby helping the trainee to stand up. Meanwhile, the rocker mechanism 3 is connected to the frame 5 for fixing the crank rocker mechanism to the frame 5, so that the crank rocker mechanism can operate stably and consistently. The crank mechanism 1 receives the kinetic energy provided by the motor 7 through intermediate axle 18.

Figure 4:
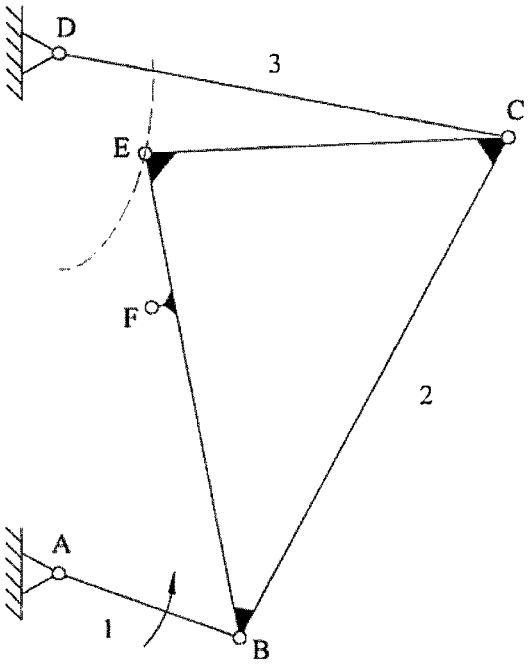
FIG. 4 is a schematic drawing showing movement of the invention crank rocker mechanism.

As shown in FIG. 4, the crank mechanism 1 is located below the rocker mechanism 3. One end A of the crank mechanism 1 and one end D of the rocker mechanism 3 are rotatably fixed to different locations on the same vertical line by means of hinges. The crank mechanism 1 and the crank mechanism 3 rotate in the vertical direction. The crank mechanism 1 has its opposite end rotatably connected to the first apex B of the triangular linkage mechanism 2. The crank mechanism 1 and the first apex B rotate in the vertical plane. The rocker mechanism 3 has its opposite end rotatably connected to the second apex C of the triangular linkage mechanism 2. The crank mechanism 1, the triangular linkage mechanism 2, and the rocker mechanism 3 composing the crank rocker mechanism interact in the same vertical plane. The crank rocker mechanisms symmetrically provided at two sides of the backrest 4 interact in two symmetrical vertical planes, respectively. Preferably, the backrest 4 is a rectangular backrest having four apexes. The rectangular backrest 4 is provided with a curved back cushion that fits a human back, so as to provide the trainee with comfort during his/her standing-up training. Despite the description above, the backrest 4 used in the present invention is not limited to a rectangular one, but may be round, polygonal, rhombic, elliptic, etc. The curved back cushion is shaped to the backrest 4, and its surface facing the trainee's back has a curved surface complementary to the trainee's back in shape. The backrest 4 has its two sides equipped with shoulder strips that tug the trainee's shoulders during operation of the mechanism, and has its bottom end equipped with a waist band that tugs the trainee's waist.

Preferably, there are two crank rocker mechanisms installed at two symmetrical sides of the rectangular backrest. The rectangular backrest has its two apexes at the same end fixed to the second driven link BE between the third and first apexes of the triangular linkage mechanism. Particularly, the rectangular backrest's upper apexes are connected to the third apex E of the triangular linkage mechanism 2, and its lower apexes are fixed to a site F on the second driven link BE. F is a corresponding fixing point for fixing the backrest 4 between the third apex E and the first apex B of the triangular linkage mechanism. The distance of the EF part of the link is equal to that between the upper and lower ends of the rectangular backrest.

The seat unit 300 is for the trainee to sit when he/she returns to a sitting posture from a standing posture, so that the trainee can continue the sitting-rising circle without using unnecessary effort.

The seat unit 300 includes the back cushion, a fastening mechanism, a seat support, and a seat cushion. The seat support is composed of a U-shaped structure and a bar-like structure that is vertically connected to the U-shaped structure as a whole. The bar-like structure of the seat support is fixed to the vertical tube 11 of the frame 5 by means of the fastening mechanism in an altitude-adjustable manner. In use, the seat support is adjusted in terms of altitude to match the trainee, and is fixed to the vertical tube 11 of the frame 5 using the fastening mechanism, so as to support the trainee comfortably when he/she stands and sits.

The U-shaped structure has each of its two ends provided with at least one through hole for adjustably fixing the seat cushion so that the seat cushion can be moved forward and backward before fixed. Preferably, the U-shaped structure's two ends are each provided with at least one round through hole. Preferably, the U-shaped structure's two ends are each provided with three round through holes. The back cushion is disposed at one end of the bar-like structure. Adjustment of the seat cushion can be achieved by changing the through holes where the seat 6 is fixed to using screw bolts, so as to allow the trainee to sit comfortably.

The present invention provides standing aid to a trainee in a way described below.

After the seat unit 300 is positioned to fit the trainee's stature, the trainee sits on the seat cushion. The backrest 4 is lowered to the trainee's back. Then the at least two shoulder strips of the backrest 4 are put on the trainee's shoulders, so that the trainee's shoulders lean closely on the backrest 4. The transverse waist band is transversely put around the trainee's waist, so that the trainee's trunk moves with the backrest 4. As a result of the cooperative fixing work of the two shoulder strips and the transverse waist band, the trainee's trunk leans closely on the backrest 4.

After the trainee sits back and is fastened by the shoulder strips and the waist band, he/she can activate a switch for training. The motor 7 accordingly starts and begins to rotate forward, thereby driving the long axle 9 to rotate through the primary chain drive mechanism 8. The long axle 9 then drives the secondary chain drive low-speed wheels 19 to perform reduced drive by means of the secondary chain drive mechanisms 10 at its two ends. The secondary chain drive low-speed wheels 19 are connected to the crank mechanisms 1 by means of the intermediate axles 18. The crank mechanisms 1 are driven by the secondary chain drive low-speed wheels 19 to perform reduced rotation. The motor 7 rotates to and fro within a certain angular range. The crank mechanisms 1 rotate to and fro under the transmission among the first chain drive mechanism 8, the long axle 9, the second chain drive mechanisms 10, and the second chain drive low-speed wheels 19.

The crank mechanisms 1 are driven by the motor 7 to first rotate upward. The triangular linkage mechanisms 2 are then driven by the crank mechanisms 1 to correspondingly rotate. The rocker mechanisms 3 follow the movement of the triangular linkage mechanisms 2 to rotate. The third apexes E of the triangular linkage mechanisms 2 drive the backrest 4 to move upward following the shoulder motion curve, so that the trainee stands up progressively with the assistance of the backrest 4. After the trainee reaches a standard standing posture, the motor 7 begins to rotate reversely. The crank mechanisms 1 rotate downward slowly as they are drawn by the first chain drive mechanism 8 and the second drive chain mechanisms 10. The triangular linkage mechanisms 2, in response to the rotating force of the crank mechanisms 1, move correspondingly. The third apexes E of the triangular linkage mechanisms 2 drive the backrest 4 to move downward following the shoulder motion curve. With the assistance of the backrest 4, the trainee's shoulders move downward together with the backrest 4 following the shoulder motion curve. As a result, the trainee returns to the sitting posture from the standing posture progressively and finally sits on the seat cushion of the seat unit 300.

Embodiment 1

The present embodiment is particularly detailed about the crank rocker mechanism.

Also referring to FIG. 4, the crank rocker mechanism at either side of the backrest 4 is described herein for illustrating the movement of the crank rocker mechanism.

Throughout the process where the crank mechanism 1 drives the triangular linkage mechanism 2 to move roughly upward and roughly downward, an included angle between the second driven link BE that is connected to the crank mechanism 1 and included in the triangular linkage mechanism 2 and the crank mechanism 1 remains smaller than 90.degree. This ensures that the backrest 4 connected to the second driven link BE is always in a reclining posture, thereby providing additional support to the human body in an obliquely upward direction.

According to one preferred mode, during the process where the triangular linkage mechanism 2 moves roughly upward and roughly downward and makes a human body exercise the sitting-rising training, the crank mechanism 1 drives the triangular linkage mechanism 2 to move obliquely upward or obliquely downward, thereby making the backrest 4 connected to the second driven link BE of the triangular linkage mechanism 2 moves in an obliquely upward or obliquely downward trajectory. This ensures that the human body during the standing up or sitting down movement moves in a trajectory that is ergonomically.

The triangular linkage mechanism 2 is articulated to the crank mechanism 1 at the rigid joint between the first driven link BC and the second driven link BE. The triangular linkage mechanism 2 is articulated to the rocker mechanism 3 at the rigid joint between the first driven link BC and the third driven link CE.

Preferably, the crank mechanism 1, the rocker mechanism 3, and the triangular linkage mechanism 2 have the proportion of their sides fixed. Preferably, the crank mechanism 1 has a length $L_{AB}$, and the first driven link BC of the triangular linkage mechanism 2 has a length $L_{BC}$, while the rocker mechanism 3 has a length $L_{CD}$, with their proportion as $L_{AB}:L_{BC}:L_{CD}=25:77:63$. Since the three interior angles of the triangular linkage mechanism 2 remains unchanged, the proportion of the lengths of the three sides of the triangular linkage mechanism 2 remains unchanged. The crank mechanism 1, the three driven links of the triangular linkage mechanism 2, and the rocker mechanism 3 have their lengths maintaining a fixed proportion. The position of the third apex E of the triangular linkage mechanism 2 has a displacement curve consistent in the average shoulder motion curve formed during an adult's standing up. The positions displacement curve of the third apex E of the triangular linkage mechanism 2 reflects the shoulder motion curve formed when a trainee is standing up. The present invention takes five most representative shoulder positions during an adult's standing up as its parameters, as shown in Table 1.

TABLE 1

| | 1 | 2 | 3 | 4 | 5 |
|---|---|---|---|---|---|
| X | −6.41 | −2.85 | −0.4 | 1 | 0.9 |
| Y | −9.8 | −9.5 | −6.3 | 3.3 | 8.6 |
| θ | −20° | −5° | 0° | 0° | 0° |

The present invention has the end A of the crank mechanism 1 and the end D of the rocker mechanism 3 located at different positions in the vertical line X=−6. The shoulder positions of a human body corresponding to five postures during an adult's standing up are presented in a rectangular coordinate plane, and the five shoulder positions are linked into a shoulder motion curve. The backrest 4 is fixed between the two triangular linkage mechanisms 2, and guided by third apexes E to move the trainee's shoulders following the shoulder motion curve, thereby helping the trainee transit from a sitting posture to a standing posture.

Embodiment 2

The present embodiment relates to further improvements to the present invention, and any feature that has been described is not repeated herein.

Figure 3:
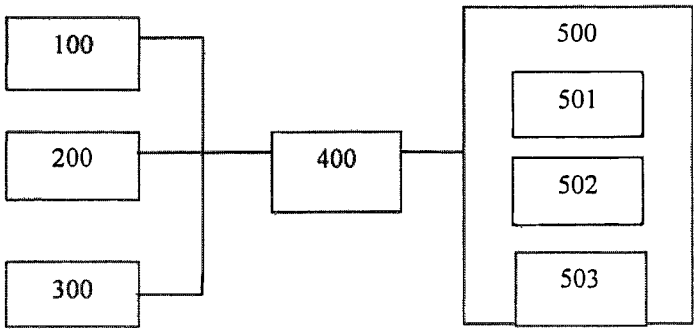
FIG. 3 is a block diagram illustrating the logic module of the invention medical apparatus.

The present embodiment provides a medical apparatus, with a logic module as schematically shown in FIG. 3. The medical apparatus of the present embodiment comprises a data harvesting unit 400 and a motion-assessing unit 500 in addition to the driving unit 100, the linkage unit 200, and the seat unit 300.

The data harvesting unit 400 serves to collect the trainee's exercise data during his/her training. The exercise data include the trainee's foot load, training frequency, training duration, biological information and shoulder motion curve. The biological information includes the trainee's body weight, heart rate, blood pressure, body temperature, pulse, breathing rate, and other variable physiological parameters.

The data harvesting unit 400 comprises at least one pressure sensor disposed on the footrest 17 at the lower end of the frame 5, as well as a biological information sensor and a shoulder motion curve sensor installed on the backrest 4. Preferably, at least one pressure sensor is installed on the footrest 17. The pressure sensor serves to monitor the trainee's pressure variation and body weight variation during his/her sitting-rising training. As shown in FIG. 8, a heart rate sensor, a body temperature sensor, a blood pressure sensor, a breathing rate sensor, a training frequency sensor and/or a motion curve sensor are provided on the at least two shoulder strips and the at least one waist band of the backrest 4 for holding the trainee in position. These sensors serve to monitor variation of the trainee's body temperature, blood pressure, breathing rate and/or the motion curve of the backrest 4 during the training. Preferably, the data harvesting unit 400 further comprises pulse sensors attached to the wristband. Preferably, the backrest 4 has its two ends each provided with a motion curve sensor. Since the trainee's shoulder motion curve is identical to the motion curve of the backrest 4, the motion curve sensors indirectly monitor the trainee's shoulder motion curve.

The motion-assessing unit 500 serves to assess the trainee's health according to the pressure data, training frequency data and/or trainee's biological information data collected by the data harvesting unit 400, and make real-time adjustment to the trainee's training frequency and training duration.

Preferably, the motion-assessing unit 500 fits a shoulder motion curve to the trainee according to an experimental shoulder-motion curve and a standard shoulder-motion curve, and corrects the trainee's motion trajectory according to the shoulder motion curve. The motion-assessing unit 500 may be installed on the frame 5 or on the backrest 4 and may perform data transmission in a wired or wireless manner. Alternatively, it may be installed in a smart mobile terminal to transmit data wirelessly.

Preferably, the motion-assessing unit 500 comprises a data processing unit 501, an assessment unit 502, and a control unit 503. The data collected by all the sensors of the data harvesting unit 400 may include data that are ineffective, or outside a predetermine tolerance range. The data processing unit 501 filters the data from the data harvesting unit 400 by removing data outside the tolerance range and only sending data that are accurate and effective to the assessment unit 502.

The assessment unit 502 assesses the trainee's physical condition according to the received effective data. For example, if the trainee has his/her heart rate increases during the standing-up training to the extent that its exceeds an average level, the assessment unit 502 instructs the control unit 503 to decrease the training frequency until the trainee's heart rate decreases to the normal level. The assessment unit 502 stores a standard shoulder-motion curve obtained through scientific calculation. At the first time the trainee receives the sitting-rising training, the assessment unit 502 compares the trainee's experimental shoulder-motion curve to the stored standard shoulder-motion curve. If the difference between the experimental shoulder-motion curve and the standard shoulder-motion curve does not exceed a predetermined tolerance range, no correction is made to the trainee's standing-up training. If the experimental shoulder-motion curve and the standard shoulder-motion curve are very different, the assessment unit 502 sends a command of correction to the control unit 503, and the control unit 503 accordingly adjusts the shoulder motion curve of the linkage unit 200 to make the trainee's shoulders move following the standard shoulder curve, thereby making the trainee stands up in a normal way.

The control unit 503 is connected to the driving unit 100 and the linkage unit 200. The control unit 503 adjusts the trainee's training frequency, training duration and shoulder motion curve according to the assessment made by the assessment unit 502.

Preferably, the assessment unit 502 stores linkage unit adjusting data associated with children of various age groups. The assessment unit 502 assesses and selects linkage unit adjusting data suitable to the trainee according to trainee's biological information data. The assessment unit 502 sends the linkage unit adjusting data to the control unit 503. The control unit 503 then adjusts the linkage unit according to the received linkage unit adjusting data.

Preferably, the mechanisms in the linkage unit 200 may be adjusted manually and mechanically, or may be adjusted electrically and mechanically. Preferably, in the present invention, the crank mechanism 1, the triangular linkage mechanisms 2 and the rocker mechanisms 3 of the linkage unit 200 are adjusted electrically and mechanically. Preferably, the crank mechanism 1 and the rocker mechanisms 3 are rod-like with their lengths adjustable. The triangular linkage mechanism 2 has its three sides formed by three metal rods each having an electrically adjustable length. The control unit 503 electrically and mechanically adjusts the apex A of the crank mechanism 1, the apex D and the length of each said rocker mechanism 3, and the lengths of the three sides of each said triangular linkage mechanism 2 according to the adjusting data prepared by the assessment unit 502. The scale adjustment among the crank mechanism 1, the rocker mechanisms 3 and the triangular linkage mechanisms 2 ensures that the shoulder motion curve of the backrest 4 is consistent, thereby making the linkage unit 200 fit the trainee's body. During the trainee's sitting-rising training, the shoulder motion curve is consistent in the shoulder motion curve of his/her standing-up body, thereby preventing the trainee from physical uncomfortableness.

Preferably, the assessment unit 502 is installed in a smart terminal, so that a care provider can set adjusting data for the interacting mechanisms in the linkage unit 200 through the smart terminal, thereby reducing the time required by the assessment unit 502 to assess the trainee.

Preferably, if the trainee belongs to a special group, such as a child group or a robot group, the motion-assessing unit 500 refits the shoulder motion curve according to the pressure the trainee causes to the footrest 17, the trainee's biological information, and the experimental shoulder-motion curve. Afterward, the motion-assessing unit 500 instructs the linkage unit 200 to adjust trainee's motion height and shoulder motion curve according to the refitted shoulder motion curve, thereby providing standing aid and training to children, robots and other special groups.

When the pressure sensor on the footrest 17 senses no more pressure during the trainee's standing up, it means that the travel of the training is greater than the trainee's body height. The motion-assessing unit 500 thus adjusts the travel of the standing aid provided by the linkage unit 200 again until all the data and the shoulder motion curve related to the trainee's motion fall back into the normal range.

Preferably, the motion-assessing unit 500 assesses the trainee's health according to the trainee's biological information and the training frequency collected by the data harvesting unit 400. Then the trainee's training frequency and training duration are adjusted according to the trainee's biological information data. Where the trainee's biological information is of abnormality, the motion-assessing unit 500 stops helping the trainee with the sitting-rising training, and returns the trainee to the sitting posture. Preferably, the motion-assessing unit 500 includes an alarm unit. Where the trainee's biological information is of abnormality, the alarm unit gives out an alarm message using acoustic means, lighting means and/or a combination thereof.

Preferably, the present invention is applicable to bionic robots' training for standing. An operator uses the smart terminal to register the bionic robot's body height, body weight and other physiological data into the assessment unit 502. The assessment unit 502 selects suitable adjusting data for the linkage unit 200 according to the trainee's physiological data. The control unit 503 adjusts the crank mechanism 1 and the rocker mechanisms 3 of the linkage unit 200 in terms of apex and length according to the adjusting data, while adjusting the lengths of the three sides of the triangular linkage mechanism 2 according to the adjusting data, so as to obtain the shoulder motion curve for a bionic robot. In use, the bionic robot's shoulders and trunk are fastened by the shoulder strips and the waist band on the backrest 4, so as to perform standing-up training with the assistance of the linkage unit 200. In this way, the present invention can assess the shoulder motion curve fitting a bionic robot according to the bionic robot's body height and body weight, thereby providing standing-up training to any bionic robot.

During a trainee's first sitting-rising-sitting training, the data harvesting unit 400 collects the trainee's body weight, blood pressure, heart rate, temperature, breathing rate, experimental shoulder-motion curve and other relevant data. Particularly, the pressure sensors on the footrest 17 monitor variation of the pressure the trainee gives to the footrest 17 when the trainee is standing up, and record the trainee's body weight when the trainee stands up. The temperature sensor, heart rate sensor, breathing rate sensor, and blood pressure sensor on the shoulder strips monitor variation of the trainee's body temperature, heart rate variation, breathing rate and blood pressure. The shoulder motion curve sensors on the backrest 4 monitor the shoulder motion curve.

The data harvesting unit 400 sends the collected data to the motion-assessing unit 500 in a wired or wireless manner. The data processing unit 501 receives the data sent by the data harvesting unit 400, and filters the data for effectiveness by removing data with significant errors and preserving data that are accurate and effective. The data processing unit 501 then sends the effective data to the assessment unit 502.

The assessment unit 502 assesses the trainee's health and shoulder motion curve based on the effective data. If the assessment suggests that a sitting-rising training is not suitable for the trainee in view of his/her physical status, the assessment unit 502 sends a command to the control unit 503, and the control unit 503 gives out early warning about unsuitability of training If the assessment unit 502 finds out that the trainee's physical condition is suitable for the sitting-rising training, it uses the trainee's biological information to decide the trainee's training duration and training frequency. For example, where the trainee's body weight and body height give a BMI value in a standard range, and the heart rate, blood pressure, shell temperature, breathing rate are deemed as normal, the assessment unit 502 develops a training program adopting a standard training duration and a standard training frequency. Preferably, the standard training duration is 30 minutes, and the standard training frequency is 2 rounds per minute. The trainee thus performs standing-up training according to the standard standing-up training process.

Where the trainee's body weight and body height generate a BMI value falling within the overweight range, and the heart rate, blood pressure, shell temperature, and breathing rate are deemed as normal, the assessment unit 502 determines that the standard training frequency and standard training duration are not suitable for the trainee's physical condition, and sets the trainee's training duration as 20 minutes, and training frequency as 2 rounds per minute. The trainee thus performs the standing-up training according to the determined training program. If the trainee has his/her heart rate increasing and exceeding the normal range during the standing-up training, the assessment unit 502 sends a command to the control unit 503 for decreasing the training frequency. The control unit 503 thus instructs the linkage unit 200 to decrease the training frequency according to the received command until the trainee's heart rate returns to normality.

The control unit 503 is connected to the driving unit 100 and the linkage unit 200. Particularly, the control unit 503 is connected to the motor 7 and the secondary chain drive low-speed wheel 19. The control unit 503 modulates the forward and reverse rotation frequency and duration of the motor 7 according to the assessment made by the assessment unit 502, thereby correcting the trainee's training frequency, training duration, and shoulder motion curve. In the event of emergency, such as the case where the trainee has sudden illness, the control unit 503 stops the motor 7 from rotation and instructs the secondary chain drive low-speed wheel 19 to lower the crank mechanism 1 to the lowest possible position, thereby making the backrest 4 of the linkage unit 200 lead the trainee back to a sitting posture where the trainee can be easily separated from the backrest 4 and receive first aid. The control unit 503 controls the alarm unit to give out an alarm message that warns surrounding people to provide the trainee with first aid and further assistance.

Preferably, the motion-assessing unit 500 is an electronic module installed at an arbitrary position on the frame 5. Preferably, the data processing unit 501 and the assessment unit 502 of the motion-assessing unit 500 are installed on a smart mobile terminal, while the control unit 503 is installed at an arbitrary position on the frame 5. The data harvesting unit 400 sends the collected data to the data processing unit 501 in the smart mobile terminal in a wireless manner. For example, the data harvesting unit 400 sends data to the data processing unit 501 through wireless transmission by Bluetooth, WiFi, ZigBee, iBeacon or the like. The assessment unit 502 performs assessment based on the effective data provided by the data processing unit 501, and sends the command of modulation wirelessly to the control unit 503. For example, the assessment unit 502 sends the data wirelessly to the control unit 503 by means of Bluetooth, WiFi, ZigBee, iBeacon or the like.

Preferably, the pressure sensor, the temperature sensor, the heart rate sensor, the blood pressure sensor, and the breathing rate sensor in the data harvesting unit 400 are equipped with an EnOcean module for providing power. The EnOcean module converts the trainee's thermal energy and mechanical energy into electric energy for powering the sensors.

Embodiment 3

The present embodiment relates to further improvements to Embodiment 1 and Embodiment 2, and any feature that has been described before is not repeated herein.

The following description is directed to data processing jointly performed by the disclosed apparatus and a data processing cloud terminal.

The data processing includes three parts. As the first part, an expert knowledge library is used to develop a recommended rehabilitation training program. The data processing cloud terminal includes a data pre-processing module. The data pre-processing module pre-processes the user's monitoring data and personal information coming from the mobile terminal, and normalizes the monitoring data and the personal information data into basic physiological data including the trainee's body height, body weight, and age, and physical functionality data including the level of support provided by the medical apparatus during user's every standing up. The expert knowledge library at the data processing cloud terminal determines which rehabilitation training stage the trainee is in according to the user's different physiological data and physical functionality data, and recommends different sitting-rising training programs specific to the user's different current rehabilitation stages. Such a sitting-rising training program includes the duration of a single round of sitting-rising training, the level of support provided by the medical apparatus, the number of sessions of sitting-rising training should be performed a day, and the interval between two sessions of sitting-rising training.

The second part is the real-time adjustment for the rehabilitation training program. The medical apparatus uses the sensing module to collect data and thereby monitors the trainee's rehabilitation progress. If there is a tendency that the trainee actively exert effort, the support provide by the medical apparatus is appropriately reduced, and the trainee's sitting-rising training program is updated with the support data of the medical apparatus. Similarly, the data processing cloud terminal may update the duration of a single round of sitting-rising movement, the number of sessions of sitting-rising training to be performed a day, or the interval between two sessions of sitting-rising training.

The third part is personalized update of the sitting-rising training using machine learning or the like. The data processing cloud terminal stores the rehabilitation training status of every trainee. When the rehabilitation training data from a large scale of people, cluster analysis is performed on all the trainees' rehabilitation training data using a machine learning algorithm, wherein the method of similarity measurement used for clustering involves calculating variables such as a patient's body height, body weight, age, training volume, effort percentage for every rounds of training, and so on. By clustering people having similarity, personalized rehabilitation training programs can be customized for individual trainees. A personalized rehabilitation training program includes the duration of a single round of sitting-rising movement, the level of support provided by the medical apparatus, the number of sessions of sitting-rising training to be performed a day, and the interval between two sessions of sitting-rising training.

The disclosed medical apparatus works with a mobile terminal for providing a training program recommended by a data processing cloud terminal as below. The mobile terminal receives a recommended training program fed back by the data processing cloud terminal, and uses a microcontroller to control the motor 7 of the medical apparatus, thereby controlling the trainee's duration of a single round of sitting-rising movement, the level of support provided by the medical apparatus, the number of sessions of sitting-rising training to be performed a day, the interval between two sessions of sitting-rising training, and the number of days for the current stage of training according to the feedback data. During the trainee's training, the mobile terminal not only monitors whether the training program of the day has been executed, but also evaluates every training round. After each training session, the mobile terminal sends information to the data processing cloud terminal, so that the data processing cloud terminal can analyze the trainee's training data and score the training's overall performance of the day. The mobile terminal then displays the result sent back by the data processing cloud terminal in the screen.

It should be noted that the above specific embodiments are exemplary, persons skilled in the art can devise various solutions under the inspiration of the disclosed content of the present invention, and the solutions also belong to the disclosed scope of the present invention and fall into the protection scope of the present invention. Persons skilled in the art shall understand that the specification and its drawings of the present invention are exemplary and do not limit the claims. The protection scope of the present invention is limited by the claims and its equivalents.

What is claimed is:

1. A method of using a medical apparatus for standing aid, wherein the medical apparatus comprises a crank rocker mechanism provided on at least one side of a backrest (4), a motor (7), a primary chain drive mechanism (8), and a secondary chain drive mechanism (10), wherein the crank rocker mechanism supports a trainee's body to perform sitting and rising movements, the backrest (4) provides the trainee's body with back support, and the crank rocker mechanism comprises a crank mechanism (1), a triangular-shaped linkage mechanism (2), and a rocker mechanism (3), the method comprising the steps of:

driving the primary chain drive mechanism (8) through forward rotation of the motor (7);

driving the secondary chain drive mechanism (10) by the primary chain drive mechanism (8);

driving the crank mechanism (1) to rotate at a reduced speed by the secondary chain drive low-speed wheels (19), driving the triangular-shaped linkage mechanism (2) to rotate upward by the crank mechanism (1), wherein an angle between a second driven link (BE) of the triangular-shaped linkage mechanism (2) and the crank mechanism (1) is always smaller than 90°;

driving the rocker mechanism (3) to rotate following the movement of the triangular-shaped linkage mechanism (2), such that the backrest (4) is driven by the triangular-shaped linkage mechanism (2) to move upwardly, and the trainee stands up progressively with assistance from the backrest (4);

rotating the motor (7) in reverse after the trainee reaches a standing posture;

driving the crank mechanism (1) to rotate downward by the first chain drive mechanism (8) and the second chain drive mechanism (10); and moving the triangular-shaped linkage mechanism (2) to rotate downward to drive the backrest (4) to move downwardly, such that the trainee's body returns to a sitting posture from a standing posture progressively with assistance from the backrest (4);

wherein the rocker mechanism (3) and the backrest (4) are connected to the triangular-shaped linkage mechanism (2) to perform interactive movement repeatedly along a predetermined curved trajectory in response to a drive effect resulting from a driving force of a driving unit (100), so that the backrest (4) connected to the second driven link (BE) assists the trainee in standing up repeatedly by obliquely supporting the trainee's body's waist.

2. The method of claim 1, wherein the triangular-shaped linkage mechanism (2) is of an acute triangular structure composed of a first driven link (BC), the second driven link (BE), and a third driven link (CE), wherein the method further comprises:

forming an angle of 40° between the first driven link (BC) and the second driven link (BE);

forming an angle of 60° between the first driven link (BC) and the third driven link (CE);

forming an angle of 80° between the second driven link (BE) and the third driven link (CE);

connecting an apex (E) of the triangular-shaped linkage mechanism (2) to the backrest (4) and guiding the trainee's body's shoulder fastened to the backrest (4) to perform reciprocal movement along the predetermined curved trajectory.

3. The method of claim 2, wherein the first driven link (BC) is of a length greater than the second driven link (BE), the second driven link (BE) is of a length greater than the rocker mechanism (3), the rocker mechanism (3) is of a length greater than the third driven link (CE), and the third driven link (CE) is of a length greater than the crank mechanism (1), the method further comprising:

vertically linking the crank mechanism (1), the triangular-shaped linkage mechanism (2), and the rocker mechanism (3) to drive the backrest (4) to move, and controlling the predetermined curved trajectory of the backrest (4) by the crank rocker mechanism according to a drive frequency of the driving unit (100) and a rotation angle of the motor.

4. The method of claim 2, wherein the backrest (4) is parallel to and rigidly connected to the second driven link (BE), and two connecting points between the backrest (4) and the second driven link (BE) are located within one half of the second driven link (BE) that is relatively closer to the apex (E).

5. The method of claim 4, further comprising:

adding shoulder straps to two sides of the backrest (4) to provide a first pulling force to the trainee's body's shoulders during operation of the crank rocker mechanism, and adding a waist band to the backrest (4) to provide a second pulling force to the trainee's body's waist.

6. The method of claim 3, wherein in the triangular-shaped linkage mechanism (2), the first driven link (BC) has one end of the first driven link rigidly connected to the second driven link (BE), and has an opposite end of the first driven link rigidly connected to the third driven link (CE), while the second driven link (BE) is rigidly connected to the third driven link (CE).

7. The method of claim 3, further comprising:

connecting the triangular-shaped linkage mechanism (2) to the crank mechanism (1) at a first rigid joint between the first driven link (BC) and the second driven link (BE), and connecting the triangular-shaped linkage mechanism (2) to the rocker mechanism (3) at a second rigid joint between the first driven link (BC) and the third driven link (CE).

8. The method of claim 1, further comprising:

connecting the crank mechanism (1) to an intermediate axle (18) so that the crank mechanism (1) receives kinetic energy provided by the motor (7) through the intermediate axle (18), driving the crank mechanism (1) of the crank rocker mechanism to operate with its connecting point with the intermediate axle (18) as a center of a circle and a length of the crank mechanism (1) as the radius, and driving the crank mechanism (1) of the crank rocker mechanism by the intermediate axle (18), the crank mechanism rotating clockwise or counterclockwise about the intermediate axle (18), thereby driving the entire crank rocker mechanism to tee move upward or downward.

9. The method of claim 1, wherein the medical apparatus for standing aid works with a data processing cloud terminal for smart data processing, the method further comprising:

recommending a rehabilitation training program with reference to an expert knowledge library in the cloud terminal;

performing real-time adjustment on the rehabilitation training program according to the trainee's rehabilitation progress; and performing personalized update on a sitting-rising training by using machine learning.

* * * * *